US011196193B2

(12) United States Patent
Stolze

(10) Patent No.: US 11,196,193 B2
(45) Date of Patent: Dec. 7, 2021

(54) CONDUCTOR TERMINAL, ASSORTMENT OF AT LEAST ONE BASE MODULE AND DIFFERENTLY DESIGNED CONDUCTOR CONNECTING MODULES OF A CONDUCTOR TERMINAL, AND CONDUCTOR TERMINAL BLOCK

(71) Applicant: WAGO Verwaltungsgesellschaft mbH, Minden (DE)

(72) Inventor: Henry Stolze, Bad Frankenhausen (DE)

(73) Assignee: WAGO Verwaltungesellschaft mbH, Minden (DE)

( * ) Notice: Subject to any disclaimer, the term of this patent is extended or adjusted under 35 U.S.C. 154(b) by 9 days.

(21) Appl. No.: 16/897,979

(22) Filed: Jun. 10, 2020

(65) Prior Publication Data

US 2020/0395691 A1 Dec. 17, 2020

(30) Foreign Application Priority Data

Jun. 11, 2019 (DE) ..... 20 2019 103 271.5

(51) Int. Cl.
*H01R 9/24* (2006.01)
*H01R 9/26* (2006.01)

(52) U.S. Cl.
CPC ..... *H01R 9/2675* (2013.01); *H01R 9/2408* (2013.01); *H01R 9/2491* (2013.01)

(58) Field of Classification Search
CPC ..... H01R 4/48; H01R 9/22; H01R 9/26; H01R 9/2675; H01R 9/2408; H01R 9/2491; H01R 9/24; H01B 1/20
USPC ..... 439/417, 441, 709, 712, 714, 716, 723, 439/724, 789, 796, 828, 835, 838; 7/21; 361/94, 601, 627, 629, 637–640, 716, 361/721–724, 822–823
See application file for complete search history.

(56) References Cited

U.S. PATENT DOCUMENTS 5,615,079 A * 3/1997 Eggert ..... H01R 9/2675 361/601
5,816,867 A * 10/1998 Davidsz ..... H01R 4/4818 439/828

(Continued)

FOREIGN PATENT DOCUMENTS

DE 44 38 804 C1 3/1996
DE 299 26 231 U1 5/2001

(Continued)

*Primary Examiner* — William H. Mayo, III
(74) *Attorney, Agent, or Firm* — Muncy, Geissler, Olds & Lowe, P.C.

(57) ABSTRACT

A conductor terminal for connecting at least one electrical conductor. The conductor terminal has a base module which includes mounting rail fastening elements for fastening the conductor terminal to a mounting rail. The base module includes a housing, which extends in its longitudinal direction up to two end areas of the housing. A central area of the housing is provided between the two end areas, with the central area projecting beyond the two end areas in a direction facing away from the mounting rail fastening elements. The base module also includes at least one receptacle arrangement being disposed on the base module in each of the two end areas, each for accommodating a conductor connecting module. The conductor connecting modules each include at least one conductor terminal connection designed to connect an electric conductor.

18 Claims, 10 Drawing Sheets

(56) References Cited

U.S. PATENT DOCUMENTS

| | | | | |
|---|---|---|---|---|
| 6,027,380 | A * | 2/2000 | Hanning | H01R 9/2608 439/716 |
| 6,336,824 | B1 | 1/2002 | Sorig | |
| 7,192,316 | B1 * | 3/2007 | Pollmann | H01R 9/2675 439/716 |
| 8,715,017 | B1 * | 5/2014 | Barber | H01R 13/506 439/716 |
| 10,164,349 | B2 | 12/2018 | Koellmann | |
| 2003/0045178 | A1 * | 3/2003 | Huiskamp | H01R 9/2633 439/709 |

FOREIGN PATENT DOCUMENTS

| | | | |
|---|---|---|---|
| DE | 10 2015 119 247 | A1 | 5/2017 |
| EP | 1 734 551 | A1 | 12/2006 |
| EP | 2 648 494 | B1 | 10/2016 |

* cited by examiner

CONDUCTOR TERMINAL, ASSORTMENT OF AT LEAST ONE BASE MODULE AND DIFFERENTLY DESIGNED CONDUCTOR CONNECTING MODULES OF A CONDUCTOR TERMINAL, AND CONDUCTOR TERMINAL BLOCK

This nonprovisional application claims priority under 35 U.S.C. § 119(a) to German Patent Application No. 20 2019 103 271.5, which was filed in Germany on Jun. 11, 2019, and which is herein incorporated by reference.

BACKGROUND OF THE INVENTION

Field of the Invention

The present invention relates to conductor terminal for connecting electrical conductors having a modular design, made up of a base module and one or multiple conductor connecting modules. The invention also relates to an assortment of at least one base module and differently designed conductor connecting modules of a conductor terminal of this type, and a conductor terminal block.

Description of the Background Art

In general, the invention relates to the field of electrical conductor connecting technology. Conductor terminals are known in a wide range of embodiments, for example as terminal strips, socket terminals or other conductor terminals. Conductor terminals of this type are also available in a wide range of embodiments with regard to the connecting technology used, for example with spring-loaded terminal connections, screw connections or other conductor connections. In addition, different variants exist for actuating clamping springs in spring-loaded terminal connections, e.g. with lever actuation, pushbutton actuation or actuation by means of an external tool.

SUMMARY OF THE INVENTION

It is therefore an object of the present invention to further improve a conductor terminal of this type.

In an exemplary embodiment, a conductor terminal is provided for connecting at least one electrical conductor, comprising a base module, which includes mounting rail fastening elements for fastening the conductor terminal to a mounting rail, the base module including a housing, which extends in its longitudinal direction up to two end areas of the housing, the housing having a central area between the end areas, which projects over the end areas of the housing in a direction facing away from the mounting rail fastening elements, at least one receptacle arrangement for accommodating a conductor connecting module on the base module being disposed in each of the two end areas, the conductor connecting module including at least one conductor terminal connection designed to connect an electric conductor. A conductor terminal having a modular design is thus proposed, which may be preassembled by the end user by connecting or otherwise accommodating selectable conductor connecting modules suitable for the application in each case. For example, conductor connecting modules having different connecting technologies may be provided, e.g. screw connection and/or spring-loaded terminal connection. With regard to the conductor connecting modules with spring-loaded terminal connection, different variants may be provided with respect to the actuation of the clamping spring, e.g. with lever actuation, pushbutton actuation or without an integrated actuating element, the actuation of the clamping spring in this case having to take place by means of an external tool. In addition, different variants of conductor connecting modules may be provided, which differ from each other with regard to the number of conductor terminals, e.g. conductor connecting modules having one, two, three or even more conductor terminals.

A large number of combination possibilities is provided hereby for the user. A simplification in terms of the production and warehousing of the individual modules results for the manufacturer. In this way, the flexibility and speed of fulfilling special customer wishes may also be increased on the part of the manufacturer.

The receptacle arrangements disposed in the two end areas are thus disposed on the base module on the sides of the central area facing away from each other. In this way, a receptacle arrangement may have to contact sides oriented at an angle (e.g. perpendicularly to each other) for contact and coupling with corresponding contact sides or coupling sides of the conductor connecting module. These receptacle arrangements disposed on the sides of the central area facing away from each other may be designed to be, for example, mirror-symmetrical with respect to each other.

The conductor terminal can be designed as a terminal strip. This may improve flexibility for the end user in establishing a wiring system, e.g. in control cabinets, due to a terminal strip of this type having a modular design.

A conductor terminal can be used to connect an electrical conductor with the aid of at least one terminal element. The terminal element may be designed, for example, as a screw terminal element or as a spring-loaded terminal element. In addition, a conductor terminal may have a conductor insertion opening and/or a conductor insertion channel on the housing of the particular element, i.e. the base module or the conductor connecting module, through which an electrical conductor may be guided to the conductor terminal in the housing.

A conductor connecting module may be detachably accommodated on a receptacle arrangement. This has the advantage that, for example, the end user may remove an accommodated conductor connecting module and replace it with another conductor connecting module. This gives the user the ability to change the conductor terminal with respect to its preassembly later on during its use.

A particular receptacle arrangement can include at least one connecting element for mechanically fixing a conductor connecting module to the base module and/or at least one electrical connecting element for establishing an electrical connection of the conductor connecting module to at least one current-conducting element of the base module. The necessary mechanical connection and fixing as well as the electrical connection may easily take place hereby. The mechanical connecting element may be designed as a connecting element which is separate from the electrical connecting element. The mechanical connecting element and the electrical connecting element may also be designed as a joint connecting element. For example, the electrical connecting element may simultaneously be a mechanical connecting element. In particular, if the electrical connecting element is designed as a plug connection element in the manner of a plug connector, it may additionally also perform the function of a mechanical connecting element.

The conductor connecting module may then include a mating connecting element, which is designed as a mating piece to the mechanical connecting element of the base module, so that the mechanical connecting element and the mechanical mating connecting element may be connected to each other. A mechanical connecting element and/or mechanical mating connecting element may be designed, for example, as a latching tab, a latching hook, a latching indentation, another profile having a recess, a guide groove, a guide rail or the like. The profile may be designed, for example, as a dovetail profile or T groove.

The conductor connecting module can include an electrical mating connecting element, which is designed as a mating piece to the electrical connecting element of the base module. The electrical connecting element and the electrical mating connecting element may be designed, in particular, as a plug connecting element in the manner of an electrical plug connector, whereby it is possible to automatically establish the electrical connection between the conductor connecting module, e.g. its conductor terminal contact, and the current-conducting element of the base module when the conductor connecting module is accommodated on the receptacle arrangement.

At least one mechanical connecting element or multiple connecting elements of a receptacle arrangement of the base module can have fixing elements operating in at least two spatial directions, by means of which a conductor connecting module may be fixed on a receptacle arrangement of the base module in two fixing directions running at an angle to each other, in particular two fixing directions running perpendicularly to each other. This permits a particularly secure and reliable fixing of the conductor connecting module on the base module.

A fixing direction can run perpendicularly to a fastening plane of the conductor terminal on the mounting rail, which is defined by the mounting rail fastening elements.

According to one advantageous embodiment of the invention, it is provided that a fixing direction runs in parallel to a fastening plane of the conductor terminal on the mounting rail, which is defined by the mounting rail fastening elements.

In addition, a fixing may take place by the mechanical connecting element in a third spatial direction, which is orthogonal to the two fixing directions mentioned above. In this way, the conductor connecting module is securely fixed to the base module in all spatial directions.

The central area can extend between the mounting rail fastening elements in the longitudinal direction of the base module. The central area thus does not extend beyond the mounting rail fastening elements in the longitudinal direction of the base module. In this way, the central area is relatively short, with a compact design, which leaves a relatively large amount of accommodating space for the conductor connecting modules on the receptacle arrangements. In particular this makes it possible to also accommodate conductor connecting modules of a relatively long design, which include multiple conductor terminals arranged one after the other on a receptacle arrangement.

The conductor terminal can have an outer housing contour with a housing upper side facing away from the side of the housing on which the mounting rail fastening elements are arranged, and has particular end sides, which limit the housing in the longitudinal direction in the end areas, at least one part of the housing upper side being formed by a conductor connecting module accommodated on a receptacle arrangement of the base module, and one part of an end side of the housing of the conductor terminal being formed by housing outsides of the conductor connecting module. This gives the housing of the base module a particularly characteristic appearance with a protruding central area. The characteristic appearance of a conductor terminal, e.g. a terminal strip, is then achieved only by accommodating conductor connecting modules on the two receptacle arrangements, i.e. the conductor connecting modules are essential to the shaping of the entire conductor terminal. The rest of the housing upper side, which is not formed by the housing outsides of conductor connecting modules, may be formed, for example, by a housing upper side of the central area.

The possible accommodating or connecting directions of a conductor connecting module on a receptacle arrangement may, in principle, be arbitrarily selected. For example, a conductor connecting module may be accommodated or connected on a receptacle arrangement from above (from the housing upper side) or diagonally.

The receptacle arrangements disposed on the sides of the central area facing away from each other each can have a mechanical connecting element for mechanically fixing a conductor connecting module on the base module, which permit the conductor connecting modules to be accommodated or connected only in directions facing each other with respect to the central area. This allows an easy and haptically comfortable accommodation or connection of conductor connecting modules on the receptacle arrangements and likewise a comfortable detachment of a conductor connecting module, if this is necessary. In particular, the handling of the conductor terminal during preassembly is simplified, if it is not yet mounted on a mounting rail.

The conductor terminal can have a busbar arrangement for conducting the current from one conductor terminal connection to other conductor terminal connections of the conductor terminal, the base module including a central busbar piece, to which particular external busbar pieces arranged in the conductor connecting modules are electrically connectable, the busbar arrangement being formed by the central busbar piece and external busbar pieces connected thereto. The conductor connecting modules thus include their own (external) busbar pieces, which is favorable for conducting current from one conductor terminal connection of a conductor connecting module to the central busbar piece.

The central busbar piece or a component electrically connected thereto, can include at least one electrical plug contact connection, to which an external busbar piece of a conductor connecting module is automatically connected in the manner of an electrical plug connection when a conductor connecting module is accommodated on a receptacle arrangement. This permits an easy and reliable electrical contacting of a conductor connecting module on the base module.

The plug connection between the central busbar piece and an external busbar piece may be implemented, for example, in such a way that one of the busbar pieces includes a male plug contact connection protruding in the direction of the opposite busbar piece, and the other busbar piece includes a female plug contact connection as a mating piece thereto. The male plug contact connection may be designed, for example, as an end-side section of a busbar piece, which is designed as a contact pin, a contact blade or a longitudinally slotted contact blade. The female plug contact connection may be designed, for example, as a bent end section of a busbar piece, in which a recess, e.g. a slot-like recess running in the longitudinal direction (longitudinal slot), is disposed, into which the male plug contact connection may be inserted.

The base module can have a width extension, which is measured in the longitudinal direction of the mounting rail.

For example, the base module may, in each case, have a receptacle arrangement in the direction of the width extension.

The base module can include at least two receptacle arrangements side by side in at least one end area in the direction of its width extension, on which particular conductor connecting modules may be accommodated. In this way, a broadened base module may be implemented, which offers even more options for accommodating conductor connecting modules. For example, two narrow conductor connecting modules or one wider conductor connecting module, which is may be accommodated by two receptacle arrangements, may be accommodated on the two receptacle arrangements of an end area arranged side by side. The variability of the module conductor terminal may be even further increased hereby.

A large number of possibilities exist for designing the receptacle arrangements. A receptacle arrangement may be designed, for example, as a pivotable arrangement, in which a conductor connecting module is accommodated on the receptacle arrangement by means of a pivoting movement, using, for example, spring-loaded support contact points. According to one advantageous embodiment of the invention, it is provided that one, multiple or all receptacle arrangements are designed as plug-type receptacle arrangements, to which a conductor connecting module may be connected. This permits a conductor connecting module to be easily connected to a plug-type receptacle arrangement of this type.

The base module can include at least one conductor terminal connection of the conductor terminal. In this way, the conductor terminal has a general functionality for connecting electrical conductors via the base module, even if no conductor connecting module is accommodated there. In applications, in which this at least one conductor terminal connection of the base module is sufficient, the accommodation of conductor connecting modules may thus be dispensed with. The at least one conductor terminal connection of the base module may be designed, for example, to connect contact pins of a cross-connection link (bridge element), or to connect a stripped conductor end.

The object mentioned at the outset is also achieved by an assortment of at least one base module and differently designed conductor connecting modules of a conductor terminal of the type explained above, the conductor connecting modules of the user's choice being able to be accommodated on the receptacle arrangements of the base module for the purpose of forming the conductor terminal, a conductor connecting module including at least one conductor terminal. The advantages explained above may also be achieved hereby.

The set may additionally include, for example, at least one electronic module, which contains at least one electronic component. An electronic module of this type may also be accommodated on or connected to at least one receptacle arrangement. In this way, an electronic functionality may be added to the conductor terminal.

At least one conductor connecting module can include a conductor terminal connection designed as a spring-loaded terminal connection with a lever actuation. A lever actuation in this context means that the conductor connecting module includes a pivotable actuating lever, which is part of the conductor connecting module and is designed to actuate a clamping spring of the spring-loaded terminal connection.

At least one conductor connecting module can include a conductor terminal connection designed as a spring-loaded terminal connection with a pushbutton actuation. A pushbutton actuation in this context means that the conductor connecting module includes an actuating pushbutton, which is part of the conductor connecting module and is movable linearly and/or along an arc-shaped profile, for example by manual pressure. A clamping spring of the spring-loaded terminal connection may be actuated by means of the actuating pushbutton.

The assortment may also include at least one conductor connecting module which includes a conductor terminal connection designed as a spring-loaded terminal connection without its own actuating element. In this case, the actuation of the clamping spring must be carried out by an external tool.

The assortment may also include differently designed base modules, which differ from each other with respect to their width (enlargement in the width extension), e.g. including only one receptacle arrangement or at least two receptacle arrangements side by side in the width and/or longitudinal direction.

The assortment may also include conductor connecting modules, which are differently designed with respect to each other in terms of the number of their conductor terminals (e.g. one, two, three or more conductor terminals).

The object mentioned at the outset is furthermore achieved by a conductor terminal block, in which multiple conductor terminals are arranged side by side and form a block in this manner, one, multiple or all conductor terminals being designed as conductor terminals of the type mentioned above. The advantages explained above may also be achieved hereby. The conductor terminal block may also include conductor terminals of other embodiments. The formation of the conductor terminal block only from conductor terminals of the type explained above (according to the invention) is particularly advantageous.

At least one subset of the conductor terminals of the type explained above, which are arranged adjacent to each other, can include a shared central busbar piece in their base modules, which extends over the base modules of the subset in the width direction. Conductor terminals which are already electrically connected to each other via the central busbar piece may be provided in this way. The insertion of a bridge may then be dispensed with, at least with respect to these conductor terminals. Therefore, a corresponding bridge connection may remain free and be used for other purposes. For example, the central busbar piece may extend over two adjacent conductor terminals or even over more than two adjacent conductor terminals, possibly even over the entire conductor terminal block.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
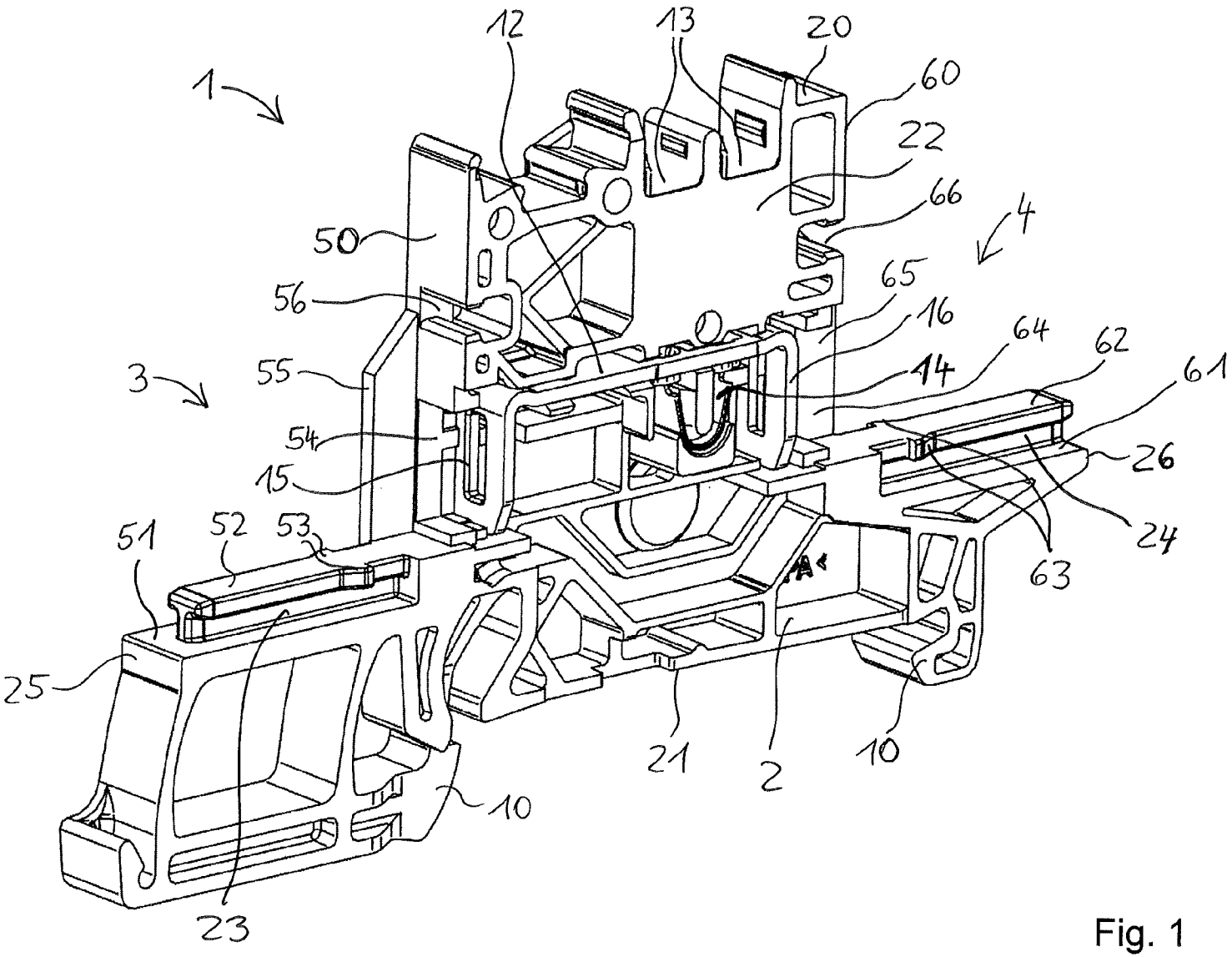
FIG. 1 shows a base module.

The base module apparent in FIG. 1 includes a housing 2. Housing 2 may be formed, for example, from an insulation material, e.g. as a plastic component. Housing 2 has end areas 23, 24 at the particular ends in longitudinal direction L, which are designed for mounting conductor connecting modules 30, 40. Housing 2 has a central area 22 between end areas 23, 24, which protrudes from a housing underside 21 in a pedestal-shaped manner. In the area of housing underside 21, housing 2 includes mounting rail fastening elements 10, by means of which housing 2 may be fastened to a mounting rail of the electrical installation system, e.g. on a DIN rail. For example, housing 2 may be fastened to the mounting rail by latching mounting rail fastening elements 10 thereto.

In each of the two end areas, 23, 24, housing 2 includes at least one receptacle arrangement 3, 4 for accommodating at least one conductor connecting module 30, 40 on base module 1. Particular receptacle arrangement 3, 4 includes mechanical connecting elements 52, 53, 56, 62, 63, 66 for mechanically fixing a conductor connecting module 30, 40 on base module 1, and electrical connecting elements 15, 16 for establishing at least one electrically conductive connection of conductor connecting module 30, 40 to at least one current-conducting element of base module 1. Base module 1 includes a central busbar piece 12 as the current-conducting element, which is provided with a bent design in its end sides facing end areas 23, 24, and has plug contact connections 15, 16 as electrical connecting elements, into which a plug contact connection 36. 46 of a conductor connecting element 30, 40 may be inserted in each case, which is designed as a mating piece. Plug contact connections 15, 16 therefore form an electrical connecting element of a particular receptacle arrangement 3, 4. Electrical plug contact connections 36, 46 of the conductor connecting modules may reach plug contact connections 15, 16 through feed openings 54, 64 and thus be electrically connected.

A guide rail 52, 62 is present on each of receptacle arrangements 3, 4 as a mechanical connecting element, which may have, for example, a T-shaped profile. Latching tabs 53 are formed on particular guide rail 52, 62 as additional mechanical connecting elements, which may protrude, for example, laterally from the T-shaped profile. Latching tabs 53, 63 are used to fix a conductor connecting module by latching it to particular guide rail 52, 62.

A latching indentation 56, 66, which extend into the interior of housing 2, is disposed on each of receptacle arrangements 3, 4 as a further mechanical connecting element. Latching indentations 56, 66 may be formed, for example, on particular walls of housing 2 designed as contact walls 50, 60, which face away from each other and form a contact surface and thus an end stop for a conductor connecting module 30, 40, which is accommodated on receptacle arrangement 3, 4. Guide rails 52, 62 may be disposed on a support wall 51, 61 of housing 2, which is situated at an angle, e.g. at a right angle, from particular contact wall 50, 60. When accommodated on a receptacle arrangement 3, 4, a conductor connecting module 30, 40 then slides along particular support wall 51, 61, conductor connecting module 30, 40 being guided by guide rail 52, 62 until it abuts contact wall 50, 60.

For the additional lateral stabilization of conductor connecting modules 30, 40, a narrow wall section 55, 65, which protrudes from contact wall 50, 60 in longitudinal direction L, may also be disposed on a receptacle arrangement. Wall sections 55, 65 are also used to increase and maintain the necessary air gaps and creepage distances between two central busbar pieces 12 of two base modules 1 disposed adjacent to each other or two conductor terminals situated adjacent to each other, formed by base modules 1 and conductor connecting modules 3, 4.

The base module may include its own conductor terminal connections, e.g. with a clamping spring 14 fastened to central busbar piece 12, by means of which two adjacent conductor terminal points are formed together with central busbar piece 12. Housing 2 may then have corresponding conductor insertion openings 13, through which electrical conductors may be guided to these conductor terminal points on clamping spring 14. FASTON tabs or pin contacts of cross-connection links, which electrically connect two or more base modules arranged side by side, may also be inserted into conductor insertion openings 13.

Figure 2:
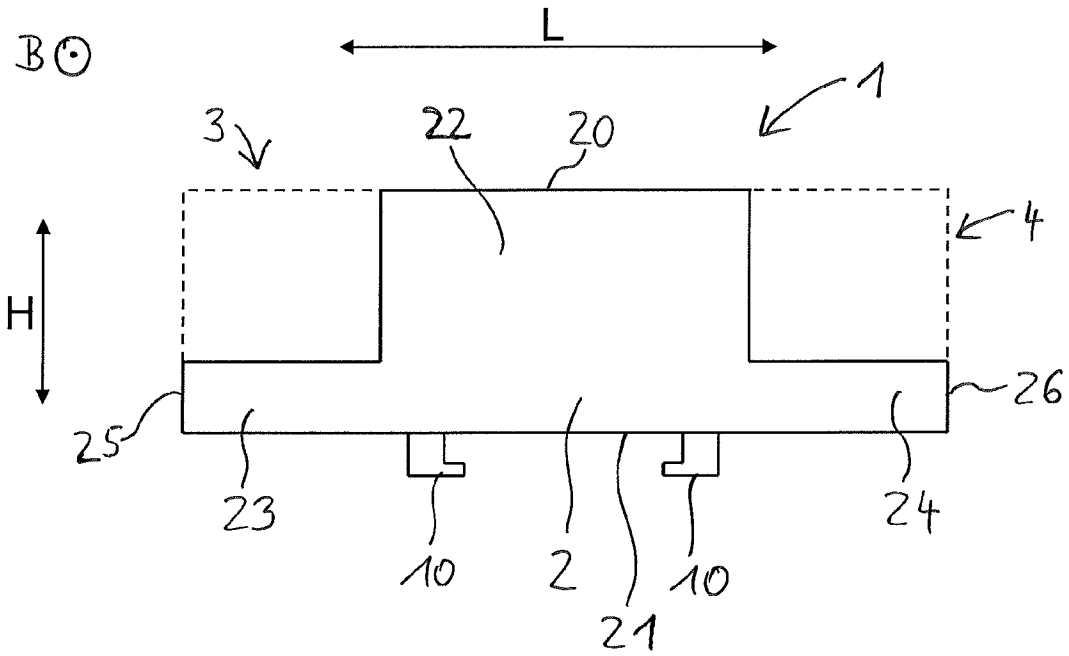
FIG. 2 show a highly schematic representation of a base module in a side view.

FIG. 2 shows base module 1 in a schematic view. This clarifies, in particular, that the longitudinal direction of base module 1 thus extends, according to arrow L, in parallel to a fastening plane of the conductor connecting module, which is defined by mounting rail fastening elements 10. A height direction H of the conductor connecting module runs perpendicularly hereto. Width direction B of the conductor connecting module runs in a spatial direction perpendicular to directions L, H, i.e. perpendicular to the paper plane of the page. It is also clarified that the final appearance of the conductor terminal is created based on initially free receptacle arrangements 3, 4 in base module 1, due to conductor connecting modules 30, 40 accommodated there, by means of which part of housing upper side 20 and parts of end sides 25, 26 are formed.

Figure 3:
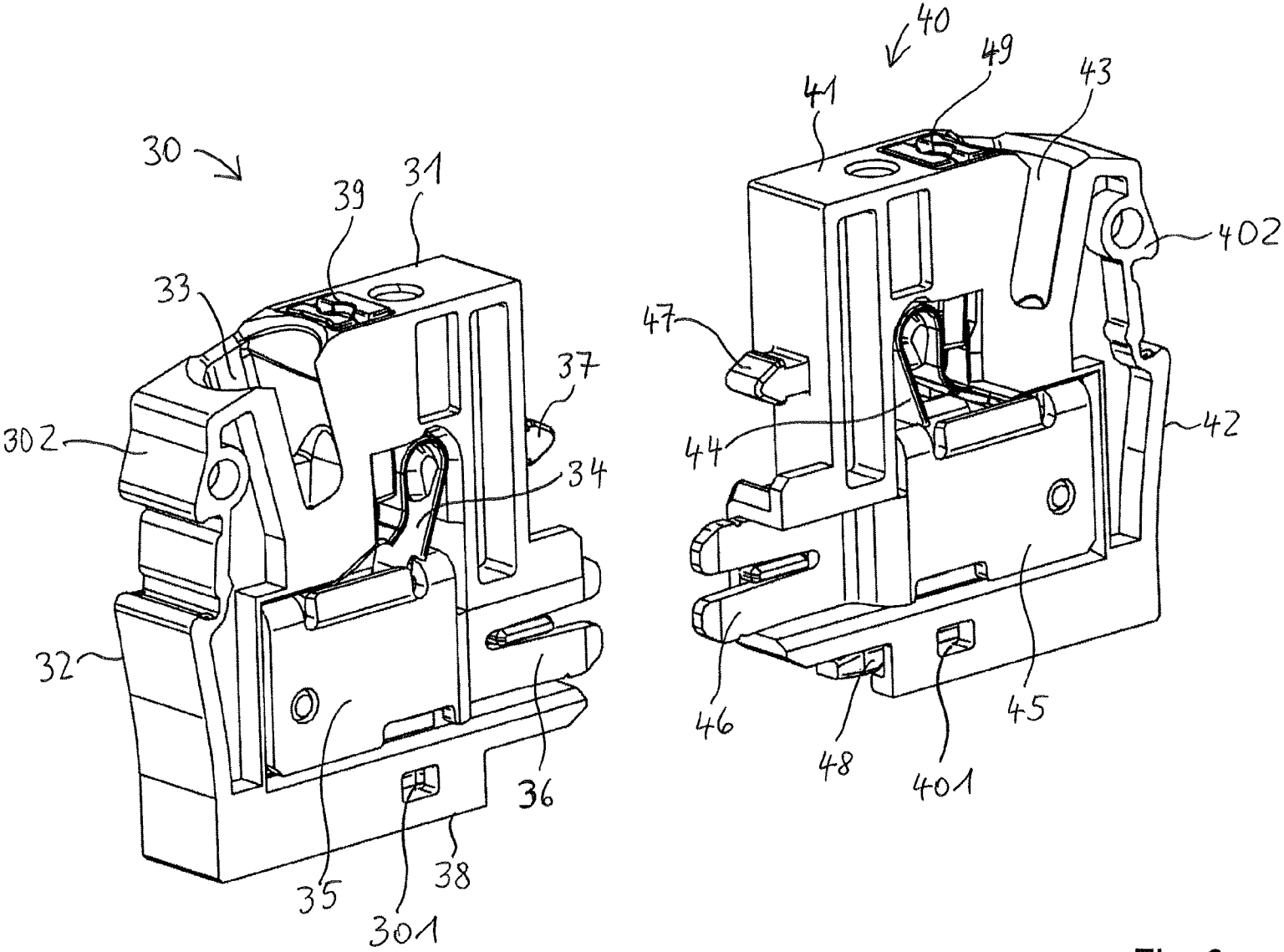
FIG. 3 shows conductor connecting modules in a first embodiment.

FIG. 3 shows two conductor connecting modules 30, 40. Conductor connecting module 30 is designed for mounting on the one receptacle arrangement 3, and conductor connecting module 40 is designed for mounting on the other receptacle arrangement 4. Conductor connecting modules 30, 40 are otherwise provided with a comparable design, so that the structure of both conductor connecting modules 30, 40 is explained at the same time below.

Each conductor connecting module 30, 40 has its own housing 302, 402, which may be made from insulation material, e.g. as a plastic component. Conductor connecting modules 30, 40 have an upper side 31, 41, which forms one part of housing upper side 20 in the case of a conductor connecting module 30, 40 accommodated on a receptacle arrangement 3, 4. Conductor connecting modules 30, 40 have particular end sides 32, 42, which each form an end side 25, 26 in the case of a conductor connecting module accommodated on a receptacle arrangement 3, 4.

Conductor connecting modules 30, 40 have conductor insertion openings 33, 43, which are used to guide an electrical conductor to a conductor terminal contact of conductor connecting module 30, 40. A conductor terminal contact is formed in both conductor connecting modules 30, 40, by means of a clamping spring 34 in connection with an external busbar piece 35, 45 in each case.

A plug contact connection 36, 46 protruding on the end side is formed on particular external busbar piece 35, 45, which is used for the purpose of insertion into plug contact connection 15, 16 of central busbar piece 12 of base module 1. Particular plug contact connection 36, 46 is formed by two spring tongues which are elastically deflectable with respect to each other. Particular plug contact connection 15, 16, however, is designed as an elongated opening in the bent end areas of busbar piece 12.

Conductor connecting modules 30, 40 have protruding latching pins 37, 47 on the housing side facing away from particular end side 32, 42, which are designed for engagement with latching indentations 56, 66.

Conductor connecting modules 30, 40 also include mechanical connecting elements 38, 48, which are designed as mating pieces for mechanical connecting elements 52, 62. In addition, latching recesses 301, 401 are situated in the housing side walls, with which particular laterally protruding latching tabs 53, 63 of a guide rail 52, 62 engage in the case of a conductor connecting module 30, 40 accommodated on a receptacle arrangement 3, 4.

A conductor connecting module 30, 40 is fixed to base module 1 in longitudinal direction L of base module 1 by the connection between latching elements 37, 56 and 47, 66. A conductor connecting module 30, 40 is fixed on base module 1 in height direction H by guide rails 52, 62 in connection with connecting elements 38, 48. In addition, a fixing in longitudinal direction L takes place by latching tabs 53, 63 engaging with latching recesses 301, 401.

Conductor connecting modules 30, 40 each include an actuating pushbutton as actuating element 39, 49, which is designed to actuate particular clamping spring 34, 44 for opening the connecting point.

Figure 4:
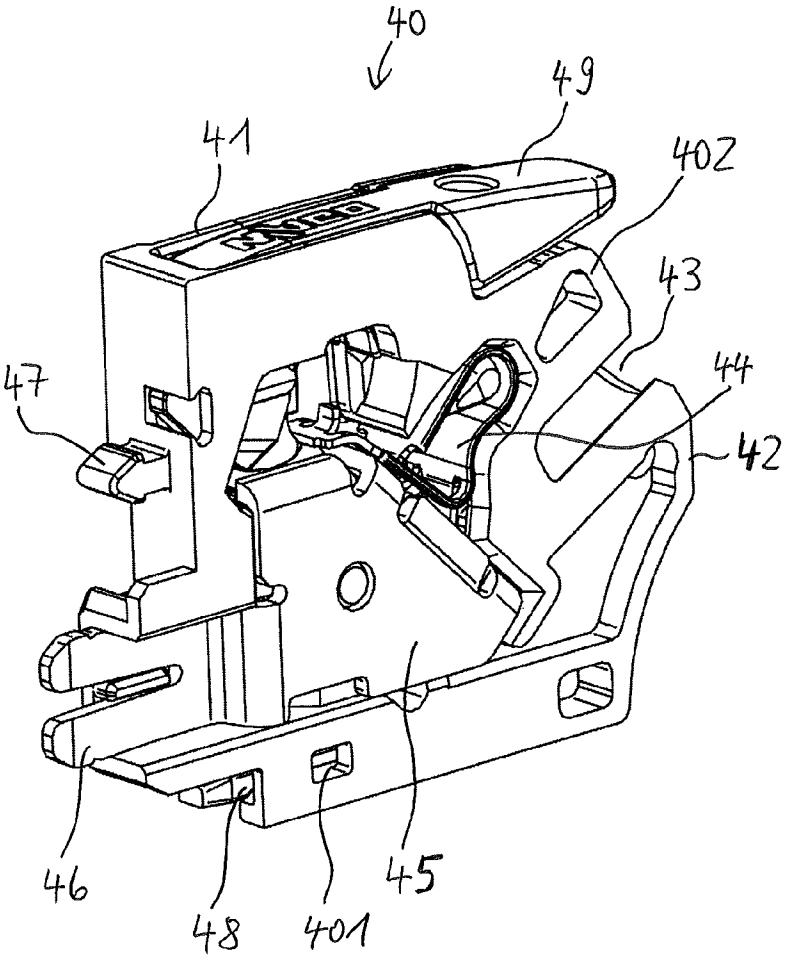
FIG. 4 shows conductor connecting modules in a second embodiment.
Figure 4:
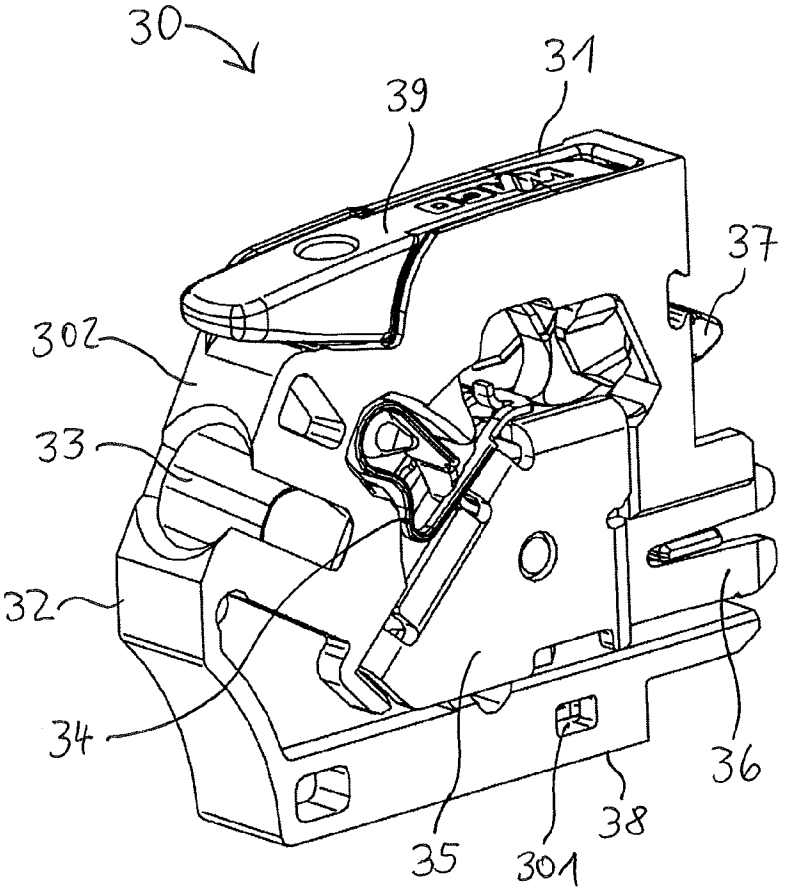

FIG. 4 shows an embodiment of conductor connecting modules 30, 40, which corresponding to conductor connecting modules 30, 40 in FIG. 3, except for the differences explained below.

In contrast to FIG. 3, a lever actuation is provided in FIG. 4 instead of a pushbutton actuation, i.e. particular conductor connecting module 30, 40 includes an actuating lever as actuating element 39, 49, which is pivotably supported on particular housing 302, 402. Due to the lever actuation, the position of conductor insertion opening 33, 43 is changed slightly with respect to the embodiment in FIG. 3. In addition, the electrical contact insert with clamping spring 34, 44 as well as busbar piece 35, 45 are adapted to the changed type of actuation with respect to their shaping.

Figure 5:
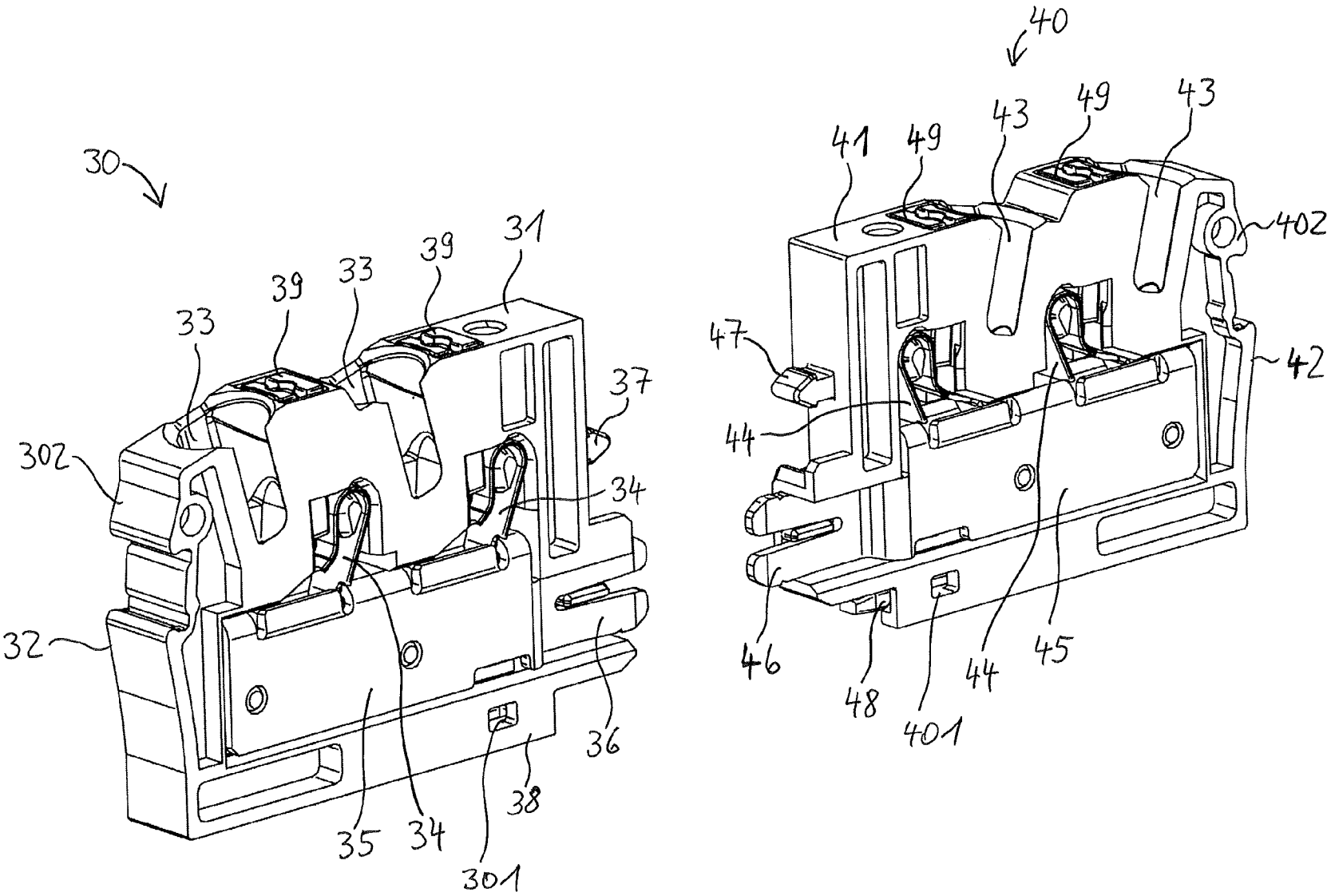
FIG. 5 shows conductor connecting modules in a third embodiment.

While conductor connecting modules 30, 40, which each include one conductor terminal connection, were described on the basis of FIGS. 3 and 4, FIG. 5 shows an embodiment of conductor connecting modules 30, 40, which each have two conductor terminal connections. The conductor terminal connections are arranged one after the other in longitudinal direction L, so that the installation length of the conductor connecting module is slightly enlarged, compared to the embodiments described above. FIG. 5 shows an embodiment of conductor connecting modules, which also have a pushbutton actuation, i.e. an embodiment comparable to FIG. 3 with respect to the type of actuation. However, this is indicated only as an example; the conductor connecting modules having multiple conductor terminal connections each may also be provided with different designs with respect to the actuating element. For example, a conductor connecting module 30, 40 may have a pushbutton actuation for one conductor terminal connection and a lever actuation for another conductor terminal connection or an actuation using an external actuating tool.

Figure 6:
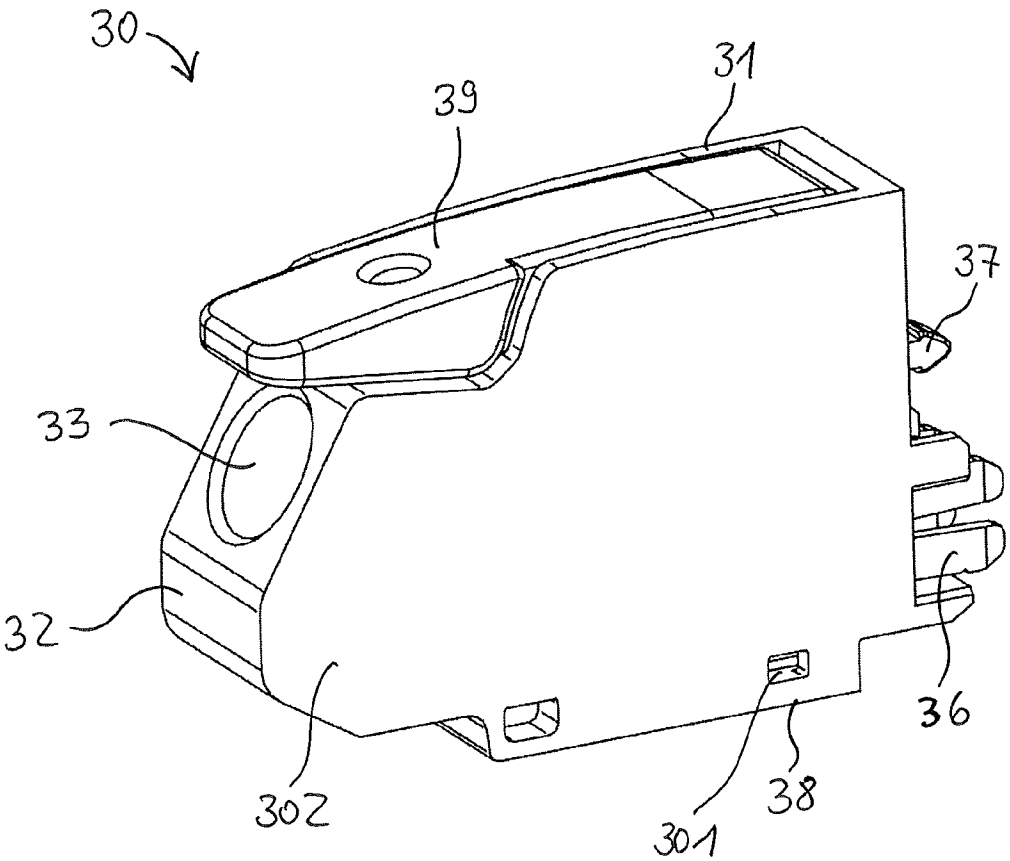
FIG. 6 shows a conductor connecting module in a fourth embodiment.

FIG. 6 shows an embodiment of a conductor connecting module 30, which has a greater width than the conductor connecting modules described above. The dimension of the conductor connecting module in width direction B is thus enlarged, i.e. twice as large. In this way, a thicker electrical contact insert as well as an enlarged conductor insertion opening 33 may be implemented. Conductor connecting module 30 is therefore designed for larger conductor cross-sections than the conductor connecting modules described above.

In this case, FIG. 6 shows an example of a lever actuation of conductor connecting module 30. The wider embodiment of the conductor connecting module may, of course, also be provided with all other actuation types of the conductor terminal connection, as described above based on the narrower embodiments.

Figure 7:
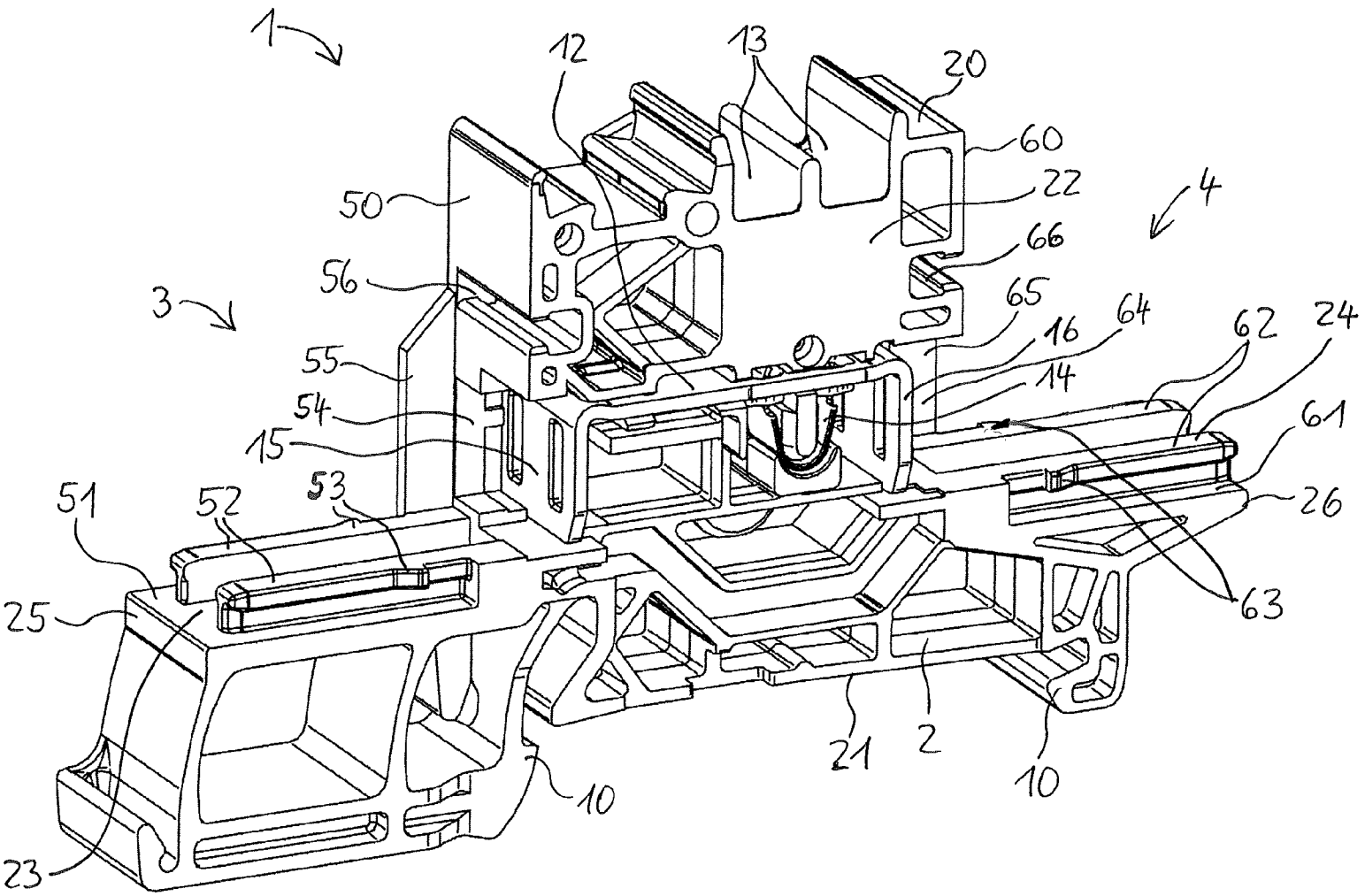
FIG. 7 shows a base module in a further embodiment.

FIG. 7 shows an embodiment of a base module 1, which has a greater width, compared to the embodiment in FIG. 1. Accordingly, two receptacle arrangements 3, 4 are arranged side by side in each end area 23, 24. This makes it possible, for example, to arrange two narrow conductor connecting modules (according to FIGS. 3 through 5) side by side in an end area 23, 24, or one wider conductor connecting module, e.g. as illustrated in FIG. 6.

Figure 8:
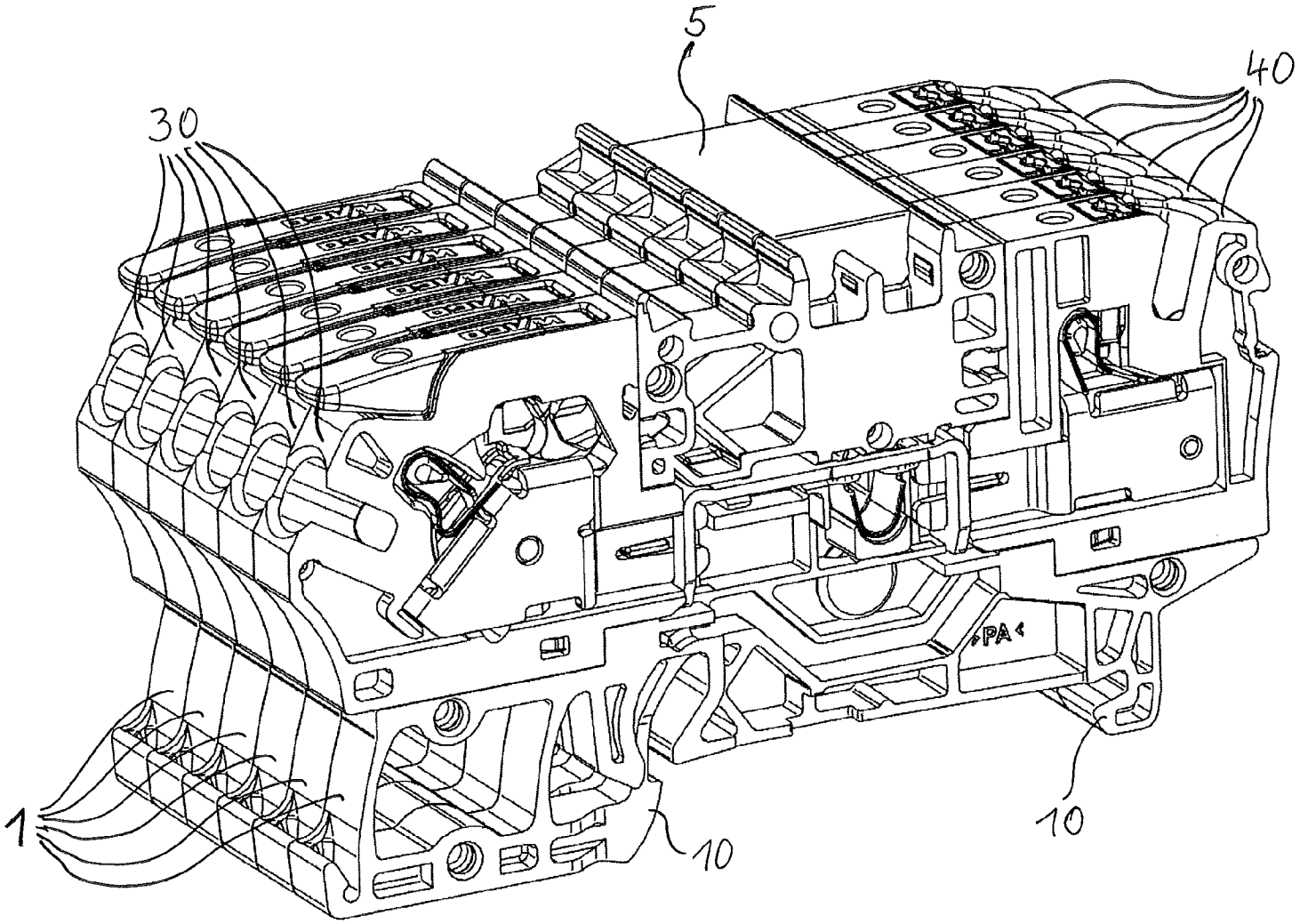
FIG. 8 shows a conductor terminal block.

FIG. 8 shows a conductor terminal block, in which multiple base modules 1 are joined together to form a block. Conductor connecting modules 30, 40 are accommodated on particular receptacle arrangements 3, 4 on base modules 1. In this way, for example, a terminal strip arrangement may be implemented, which may be engaged with a mounting rail.

FIG. 8 also show that an electrical bridging may take place between the busbar arrangements of the individual conductor connecting modules via a bridge 5, which is inserted into conductor insertion openings 13.

Figure 9:
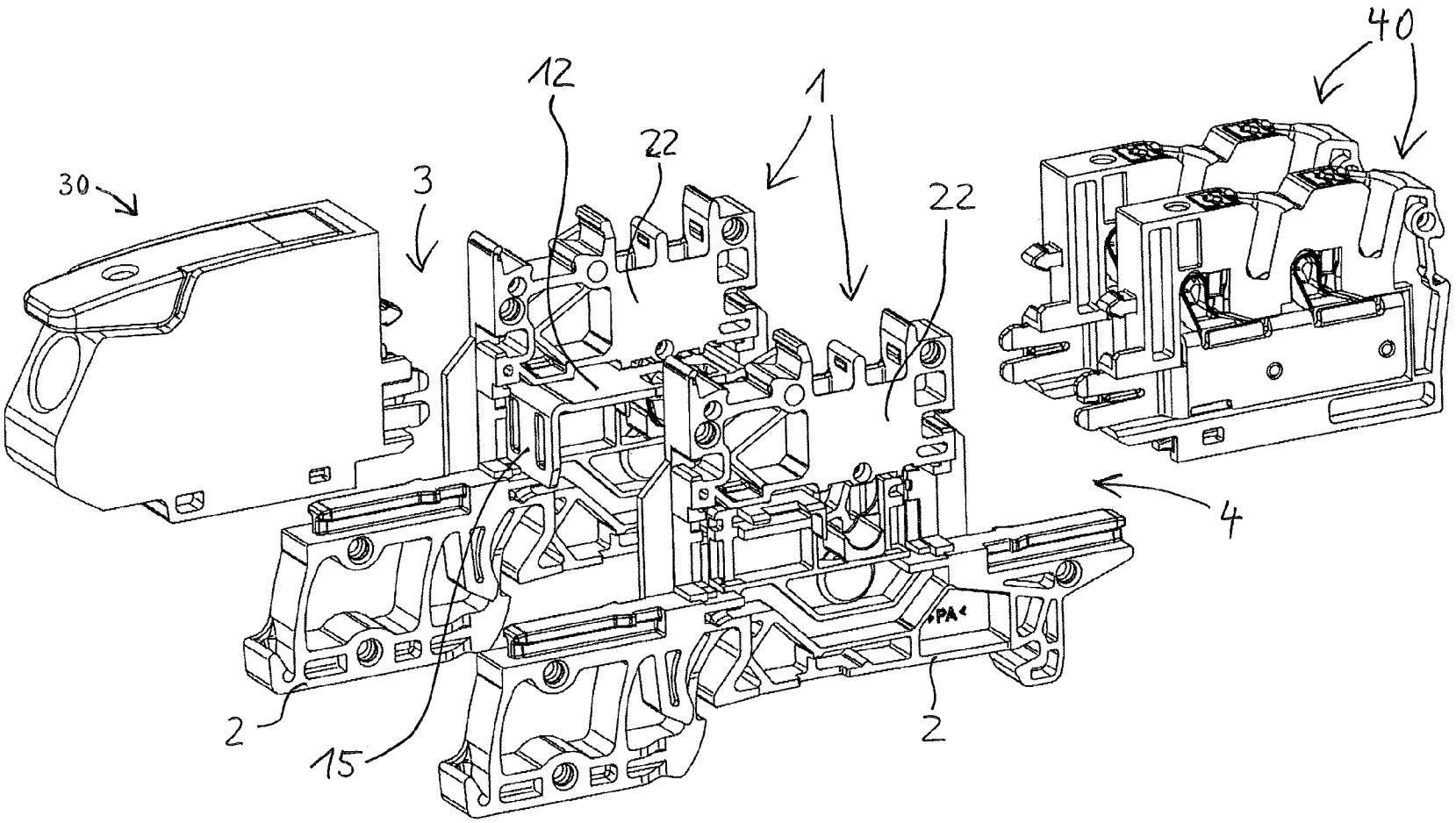
FIG. 9 shows a conductor terminal block in an exploded representation.

FIG. 9 shows an embodiment of a conductor terminal block (in an exploded representation), which has only two conductor terminals. Of course, additional conductor terminals may also be added to the terminal conductor block. Based on FIG. 9, it is clarified, in particular, that central busbar piece 12 of base module 1 of a conductor terminal may have a greater width than the actual conductor terminal or base module 1. Accordingly, central busbar piece 12 protrudes slightly to the side out of the one base module 1. If base modules 1 are interconnected to form a block, central busbar piece 12 extends over both base modules 1 and thus forms a shared busbar arrangement of these base modules 1 of the conductor terminal block. Accordingly, the insertion of a bridge 5 between these conductor terminals is not necessary, since they are already electrically connected to each other via central busbar piece 12. As is apparent, this principle may also be extended to more than two conductor terminals or base modules 1 by widening central busbar piece 12 accordingly.

FIG. 9 also shows that a wider conductor connecting module 30 may be connected to receptacle arrangement 3, and two narrow conductor connecting modules 40, for example, may be connected to receptacle arrangement 4. Of course, other combinations are also conceivable, as explained above.

Figure 10:
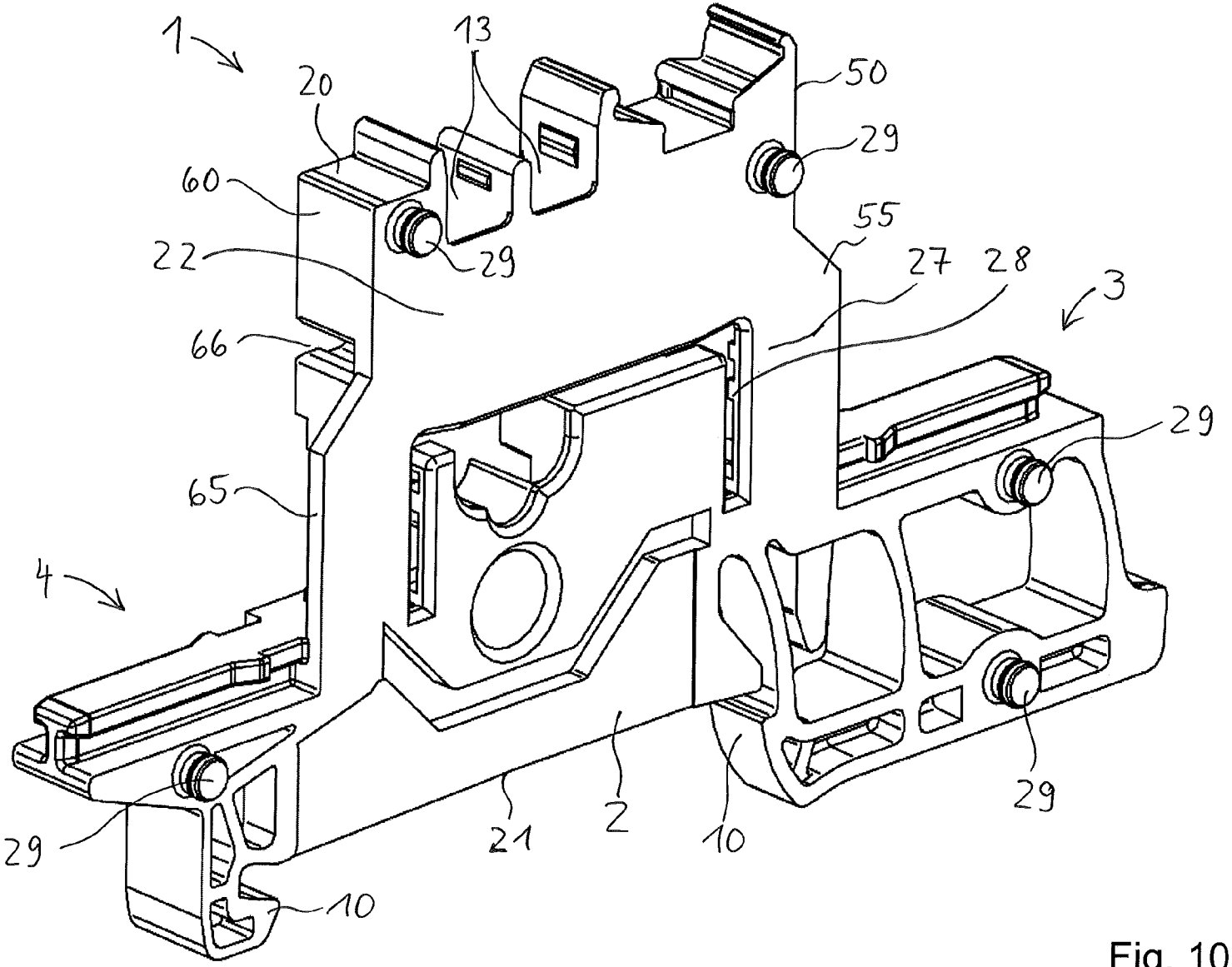
FIG. 10 shows a base module according to FIG. 1 in the opposite viewing direction.

FIG. 10 shows a base module, as illustrated in FIG. 1, which may be used, for example, for a conductor terminal block according to FIG. 9, in a view of the opposite side (rear side) of base module 1. It is apparent that base module 1 has a side wall 27 in the area of central area 22, in which a slot-shaped opening 28 is present. Slot-shaped opening 28 may have, in particular the profile shape of central busbar piece 12. This has the advantage that central busbar piece 12 may be inserted through this slot-shaped opening 28. For example, if a conductor terminal block according to FIG. 9 is to be formed, busbar piece 12 may be inserted and/or guided through slot-shaped opening 28 in side wall 27 of second base module 1 in the assembled state of two adjacent base modules 1. Side wall 27 of second base module 1 faces first base module 1 with slot-shaped opening 28.

Coupling projections 29 protruding from the one side of base module 1, which may be inserted into corresponding coupling openings of an adjacent base module 1, are also apparent. Adjacent base modules 1 may be assembled and fastened to each other hereby.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor terminal for connecting at least one electrical conductor, the conductor terminal comprising:

a base module that includes mounting rail fastening elements to fasten the conductor terminal to a mounting rail, the base module including a housing, which extends in a longitudinal direction between two end areas of the housing, the housing having a central area between the two end areas that projects beyond the two end areas of the housing in a direction facing away from the mounting rail fastening elements; and at least one receptacle arrangement to accommodate a conductor connecting module is disposed on the base module in each of the two end areas, the conductor connecting module being fixable on the at least one receptacle arrangement and including at least one conductor terminal designed to connect an electrical conductor, wherein the at least one receptacle arrangement includes at least one mechanical connecting element for mechanically fixing the conductor connecting module on the base module, and wherein the at least one mechanical connecting element of the at least one receptacle arrangement of the base module includes fixing elements operating in at least two spatial directions, via which the conductor connecting module is fixable on the at least one receptacle arrangement of the base module in two fixing directions running at an angle to each other or two fixing directions running perpendicularly to each other, and wherein a first one of the fixing elements is a guide rail that extends parallel to the longitudinal direction of the housing.

2. The conductor terminal according to claim 1, wherein the at least one receptacle arrangement includes at least one electrical connecting element for establishing an electrical connection between the conductor connecting module and at least one current-conducting element of the base module.

3. The conductor terminal according to claim 1, wherein a first one of the two fixing directions runs perpendicularly to a fastening plane of the conductor terminal on the mounting rail, which is defined by the mounting rail fastening elements.

4. The conductor terminal according to claim 3, wherein a second one of the two fixing directions runs in parallel to a fastening plane of the conductor terminal on the mounting rail, which is defined by the mounting rail fastening elements.

5. The conductor terminal according to claim 1, wherein the central area extends between the mounting rail fastening elements in the longitudinal direction of the base module.

6. The conductor terminal according to claim 1, wherein the conductor terminal has an outer housing contour with a housing upper side facing away from a housing under side on which the mounting rail fastening elements are arranged, and has end sides, which limit the housing in the longitudinal direction in the two end areas, at least one part of the housing upper side being formed by the conductor connecting module accommodated on the at least one receptacle arrangement of the base module, and one part of one of the end sides of the housing of the conductor terminal being formed by housing outsides of the conductor connecting module.

7. The conductor terminal according to claim 1, wherein the at least one receptacle arrangement disposed on each side of the central area facing away from each other each have the first one of the fixing elements for mechanically fixing the conductor connecting module on the base module, wherein the first one of the fixing elements permit the conductor connecting module on each side to be inserted only in directions facing each other with respect to the central area.

8. The conductor terminal according to claim 7, wherein the conductor terminal has a busbar arrangement for conducting a current from one conductor terminal connection to other conductor terminal connections of the conductor terminal, the base module including a central busbar piece to which an external busbar piece arranged in the conductor connecting module that is fixed to the at least one receptacle arrangement disposed on each side of the central area are electrically connectable, the busbar arrangement being formed by the central busbar piece and external busbar pieces connected thereto.

9. The conductor terminal according to claim 8, wherein the central busbar piece or a component electrically connected thereto, includes at least one electrical plug contact connection to which the external busbar piece of the conductor connecting module is connectable in the manner of an electrical plug connection when the conductor connecting module is accommodated on the at least one receptacle arrangement.

10. The conductor terminal according to claim 1, wherein the base module includes two of the at least one receptacle arrangement disposed side by side in at least one of the two end areas in a width direction, on which the conductor connecting modules are accommodated.

11. The conductor terminal according to claim 1, wherein the at least one receptacle arrangement is designed as a plug-type receptacle arrangement, to which the conductor connecting module is connected.

12. The conductor terminal according to claim 1, wherein the base module includes at least one conductor terminal connection of the conductor terminal.

13. A conductor terminal block, in which multiple conductor terminals are arranged side by side and form a block, wherein at least one of the multiple conductor terminals is designed as the conductor terminal according to claim 1.

14. The conductor terminal block according to claim 13, wherein at least a subset of the conductor terminals arranged adjacent to each other include a shared central busbar piece, wherein the central busbar piece extends over the base modules of the subset of the conductor terminals in the width direction.

15. The conductor terminal block according to claim 1, wherein the conductor connecting has a longitudinally extending recess into which the guide rail is inserted so that the conductor connecting is fixed on the at least one receptacle arrangement by being slid along the guide rail in the longitudinal direction towards the central area, and wherein a second one of the fixing elements of the at least one receptacle arrangement is a latching indentation provided on a contact wall of the housing that extends perpendicular to the longitudinal direction, wherein a protruding latch pin of the conductor connecting is fixed in the latching indentation upon sliding of the conductor connecting along the guide rail.

16. An assortment comprising:

at least one base module having receptacle arrangements and the at least one base module having a housing which extends in a longitudinal direction between two end areas of the housing, the housing having a central area between the two end areas that projects beyond the two end areas of the housing in a direction facing away from mounting rail fastening elements; and differently designed conductor connecting modules, wherein the conductor connecting modules are each fixable on the receptacle arrangements of the base module for the purpose of forming the conductor terminal, and wherein at least one of the conductor connecting modules include at least one conductor terminal connection, wherein each of the receptacle arrangements include at least one mechanical connecting element for mechanically fixing the conductor connecting modules on the base module, and wherein the at least one mechanical connecting element of each of the receptacle arrangements of the base module includes fixing elements operating in at least two spatial directions, via which the conductor connecting modules are fixable on the receptacle arrangements of the base module in two fixing directions running at an angle to each other or two fixing directions running perpendicularly to each other, and wherein a first one of the fixing elements is a guide rail that extends parallel to the longitudinal direction of the housing.

17. The assortment according to claim 16, wherein at least one of the conductor connecting modules includes a conductor terminal connection designed as a spring-loaded terminal connection with lever actuation.

18. The assortment according to claim 16, wherein at least one of the conductor connecting modules includes a conductor terminal connection designed as a spring-loaded terminal connection with pushbutton actuation.

* * * * *